US005289969A

United States Patent [19]

Schwaner

[11] Patent Number: 5,289,969

[45] Date of Patent: Mar. 1, 1994

[54] CARTON AND PACKAGING ASSEMBLY THEREFOR

[75] Inventor: Jon M. Schwaner, Greenwood, Ind.

[73] Assignee: Inland Container Corporation, Indianapolis, Ind.

[21] Appl. No.: 913,119

[22] Filed: Jul. 14, 1992

[51] Int. Cl.[5] ..... B65D 25/22

[52] U.S. Cl. ..... 229/23 R; 206/320; 229/199

[58] Field of Search ..... 206/320; 229/117.09, 229/23 R, 23 A, 199

[56] References Cited

U.S. PATENT DOCUMENTS

| | | | |
|---|---|---|---|
| 1,601,957 | 10/1926 | Gaylord . | |
| 1,639,793 | 8/1926 | Beyer . | |
| 2,083,114 | 6/1937 | Blechman | 229/23 R X |
| 2,271,265 | 1/1942 | Kirby | 229/1.5 |
| 2,474,523 | 6/1949 | Guyer . | |
| 2,474,968 | 7/1949 | Beach, Jr. | 206/46 |
| 2,752,032 | 6/1956 | Fish | 206/7 |
| 2,779,463 | 1/1957 | Zimmerman | 206/46 |
| 2,797,800 | 7/1957 | Sider | 206/46 |
| 2,960,217 | 11/1960 | Nason | 206/46 |
| 3,143,272 | 8/1964 | Webb et al. | 229/37 |
| 3,163,290 | 12/1964 | Shive | 206/65 |
| 3,194,395 | 7/1965 | Weaver et al. | 206/46 |
| 3,236,437 | 2/1966 | Johnson | 229/45 |
| 3,257,768 | 6/1966 | Harrison et al. | 53/30 |
| 3,369,652 | 2/1968 | Bebout | 206/7 |
| 3,537,635 | 11/1970 | Reas et al. | 229/51 |
| 3,543,994 | 12/1970 | Clark | 229/23 |
| 3,616,986 | 11/1971 | Wolfe | 206/320 |
| 3,675,765 | 7/1972 | Melsek | 206/46 FN |
| 3,734,389 | 5/1973 | Brown | 1206/46 FR |
| 3,835,986 | 7/1974 | Le Beau | 206/320 |
| 3,891,086 | 6/1975 | Isaacs | 206/320 |
| 3,918,580 | 11/1975 | Poggiali | 206/320 |
| 3,982,682 | 9/1976 | Fremion | 229/14 C |
| 3,999,658 | 12/1976 | Anderson | 206/320 |
| 4,019,634 | 4/1977 | Bonnot | 206/386 |
| 4,186,834 | 2/1980 | Krack | 206/320 |
| 4,226,327 | 10/1980 | Ballard | 206/320 |
| 4,248,350 | 2/1981 | Gilbert | 206/586 |
| 4,307,805 | 12/1981 | Welch et al. | 206/326 |
| 4,383,609 | 5/1983 | Lochmiller | 206/386 |
| 4,426,034 | 1/1984 | Flanagan | 229/23 BT |
| 4,427,108 | 1/1984 | Coles et al. | 206/44 R |
| 4,429,791 | 2/1984 | Ruppel et al. | 206/454 |
| 4,483,444 | 11/1984 | Gardner | 206/594 |
| 4,610,355 | 9/1986 | Maurer | 206/386 |
| 4,807,804 | 2/1989 | Schwaner et al. | 229/52 B |
| 4,811,840 | 3/1989 | Muyskens | 206/320 |

FOREIGN PATENT DOCUMENTS

| | | | |
|---|---|---|---|
| 0048454A1 | 2/1982 | European Pat. Off. . | |
| 1199689 | 8/1965 | Fed. Rep. of Germany . | |
| 2258097 | 5/1984 | Fed. Rep. of Germany . | |
| 0087892 | 8/1978 | Japan | 206/320 |

*Primary Examiner*—Allan N. Shoap
*Assistant Examiner*—Christopher McDonald
*Attorney, Agent, or Firm*—Fitch, Even, Tabin & Flannery

[57] ABSTRACT

A packaging assembly includes a pair of opposed channel members joined at their upper end by at least one intermediate cross member. The cross members and channel members are fitted together with a plug and socket arrangement. The channel members and cross members are assembled on an item to be packaged, in preparation for application of a plastic overwrap. The channel members and cross members include lifting flanges at their upper ends for mechanized handling of the package.

24 Claims, 4 Drawing Sheets

CARTON AND PACKAGING ASSEMBLY THEREFOR

BACKGROUND OF THE INVENTION

1. Field of the Invention

The present invention pertains to cartons and packaging assemblies therefor and, in particular, to packaging assemblies having translucent or transparent portions for viewing the products contained therein.

2. Description of the Related Art

For many years, appliance manufacturers preferred shipping cartons made exclusively or substantially entirely from paperboard material. For example, commonly assigned U.S. Pat. Nos. 4,807,804 and 3,734,389 provide shipping cartons for larger size items, particularly heavy manufactured items. U.S. Pat. No. 3,734,389 is illustrated for use with a refrigerator appliance and discloses corner post constructions formed of folded paperboard material. U.S. Pat. No. 4,807,804 provides a lifting flange at the top of the carton whereby the carton and its contents can be raised using a lift blade. The pocket for receiving the lift blade is integrally formed from folded portions of the carton blank, the top cover of the package being formed by folding over portions of the carton blank.

U.S. Pat. No. 3,236,437 discloses an end closure or top cap having a pocket for lifting the carton to which the closure is applied. The end closure is interlocked with sidewalls of the carton, a construction detail which is repeated in U.S. Pat. Nos. 3,163,290 and 3,616,986. The above carton constructions have solid sidewalls blocking the view of the carton contents. U.S. Pat. No. 3,982,682 discloses a folded fiberboard construction to form a corner post of a type which could be-used with the above packages. The corner post includes a hollow tubular body part and a flange at one end comprised of layers of material pressed together in intimate engagement with one another.

While the above packages have met with commercial acceptance over the years of their use, manufacturing industry and in particular the appliance manufacturing industry are turning to transparent or seethrough packages having portions through which the contents of the package may be viewed. Thus, the contents of the package may be readily inspected during shipping and transit, and also during warehousing of the commercial product, prior to delivery to a customer. Thus, if any damage is observed during the shipping and distribution process, the goods can be set aside prior to completing the product's delivery. The potential cost savings of such a system are considerable, and accordingly, interest in see-through packaging is increasing.

U.S. Pat. Nos. 3,835,986; 31891,086; and 4,811,840 show examples of see-through packages. In general, these packages have one or more hollow side portions overlaid by a plastic wrap which may be either shrink-fit to the paperboard structure, or else tightly wrapped about the paperboard structure, which serves as an internal skeleton or framework, providing the structural strength necessary for the carton, and providing a cushioning for corners of the product being shipped. U.S. Pat. Nos. 3,835,986 and 3,891,086 disclose corner post constructions which are secured to top and bottom cap members. U.S. Pat. No. 3,835,986 shows an interlocking of the corner posts and cap members, the cap members having depressions formed therein for receiving ends of the corner posts. U.S. Pat. No. 4,811,840 has a pair of side panels on each side of the product being shipped. Each panel has a pair of corner posts formed from a central portion of the panel, in a manner which forms a window through which the product being shipped can be viewed. A separate base member is provided, which completely underlies the product. The panels have top portions which telescopically interfit with one another so as to overlie the product. This construction offers a fewer number of parts, compared to packages having discreet corner posts. However, the construction is relatively complex and improvements have been sought.

SUMMARY OF THE INVENTION

It is an object according to the present invention to provide a package for use with a plastic wrap which is economically constructed from a minimum number of components.

Another object according to the present invention is to provide a package of the above-described type which includes a lifting flange at an outside corner of the package, by means of which the package may be lifted with a blade or similar member.

These and other objects according to the present invention, which will become apparent from studying the appended description and drawings, are provided in a container for holding an article having opposed sides, comprising:

a pair of channel members for engaging opposed sides of the article, each channel member formed from a single integral paperboard sheet and each having a middle body portion between a pair of channel sides extending from the middle body portion so as to form corner posts and an intermediate channel therewith for receiving the article;

at least one cross member extending between and engaging said channel members;

securement means for securing said channel members about the article;

said channel members including lifting flange means for lifting the container and article with a lifting blade; and at least one of said channel members and said cross member defining socket means for interlocking engagement with the other.

BRIEF DESCRIPTION OF THE DRAWINGS

FIGS. 14*a*–14*d* are top plan views of alternative embodiments of channel members, shown in schematic form;

DETAILED DESCRIPTION OF THE PREFERRED EMBODIMENTS

Figure 1:
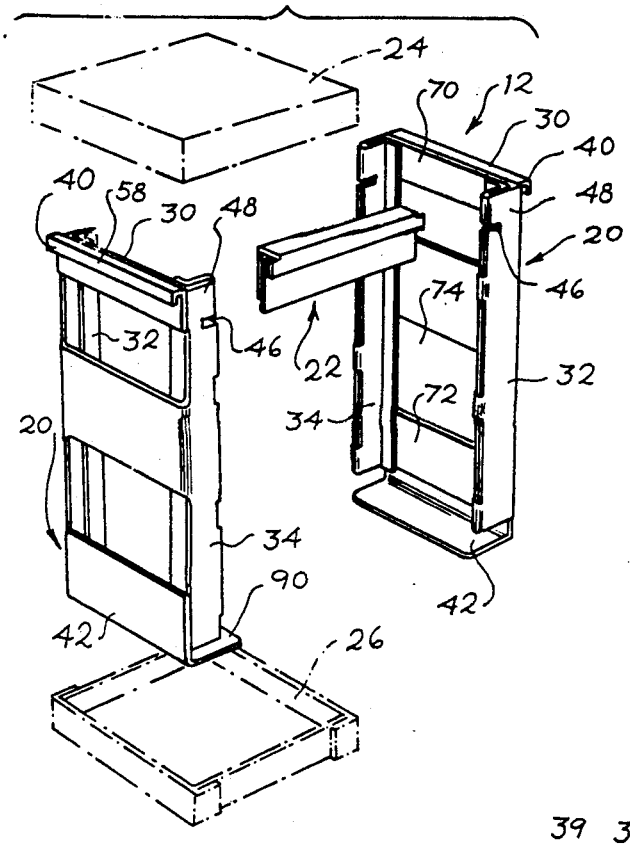
FIG. 1 is an exploded perspective view of a package assembly according to principles of the present invention.
Figure 2:
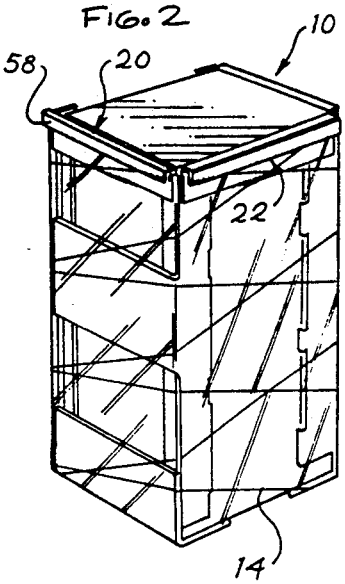
FIG. 2 is a perspective view of the package assembly including a plastic overwrap.

Referring now to the drawings, and initially to FIG. 2, packaging assembly according to principles of the present invention is generally indicated at 10. The packaging assembly 10 includes a paperboard container 12 (illustrated in FIG. 1), and a plastic film or overwrap 14 which is preferably of a type at least partially transparent. The overwrap is preferably of the shrinkwrap type, but could comprise virtually any flexible material suitable for protecting an article shipped in the packaging assembly. If desired, the flexible material may be overwrapped about the article, but disposed within the paperboard container. It is preferred that the flexible material be at least partly transparent so that the article may be easily viewed during storage and shipment without requiring disassembly of the packaging.

The paperboard container 12 is assembled about a product to be shipped, and a plastic film 14 is then wrapped about the container to form the sealed assembly illustrated in FIG. 2, ready for shipping to a remote location.

Turning now to FIG. 1, the container 12 is preferably formed of at least three discreet paperboard members, including a pair of rides of channel members 20 and a cross member generally indicated at 22. If desired, optional caps or end closures 24, 26 may be used. The end closures may be fitted between the channel members 20 or, alternatively, may be applied over the top and bottom ends of the packaging assembly illustrated in FIG. 2.

Figure 3:
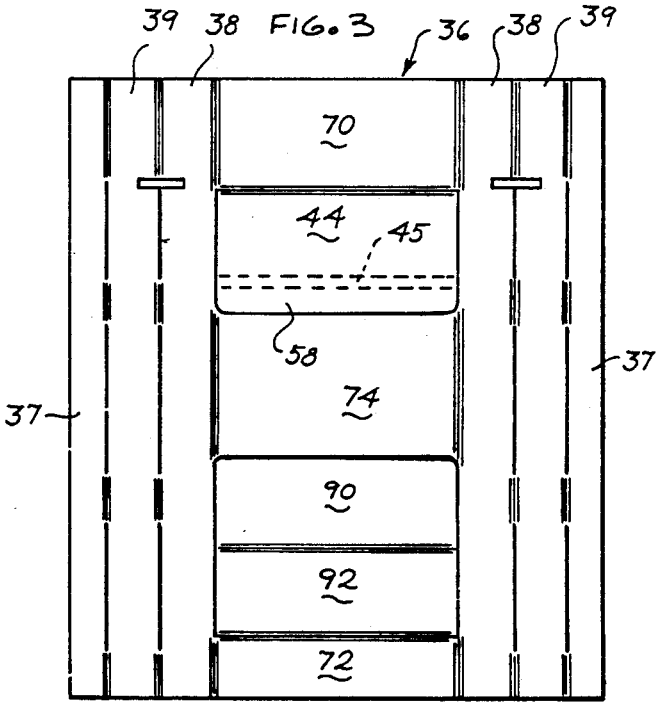
FIG. 3 is a top plan view of a blank from which the side channels of the carton of the package assembly are made.
Figures 5, 6, 7, 8, 9, 10, 11, 12, 13, 14:
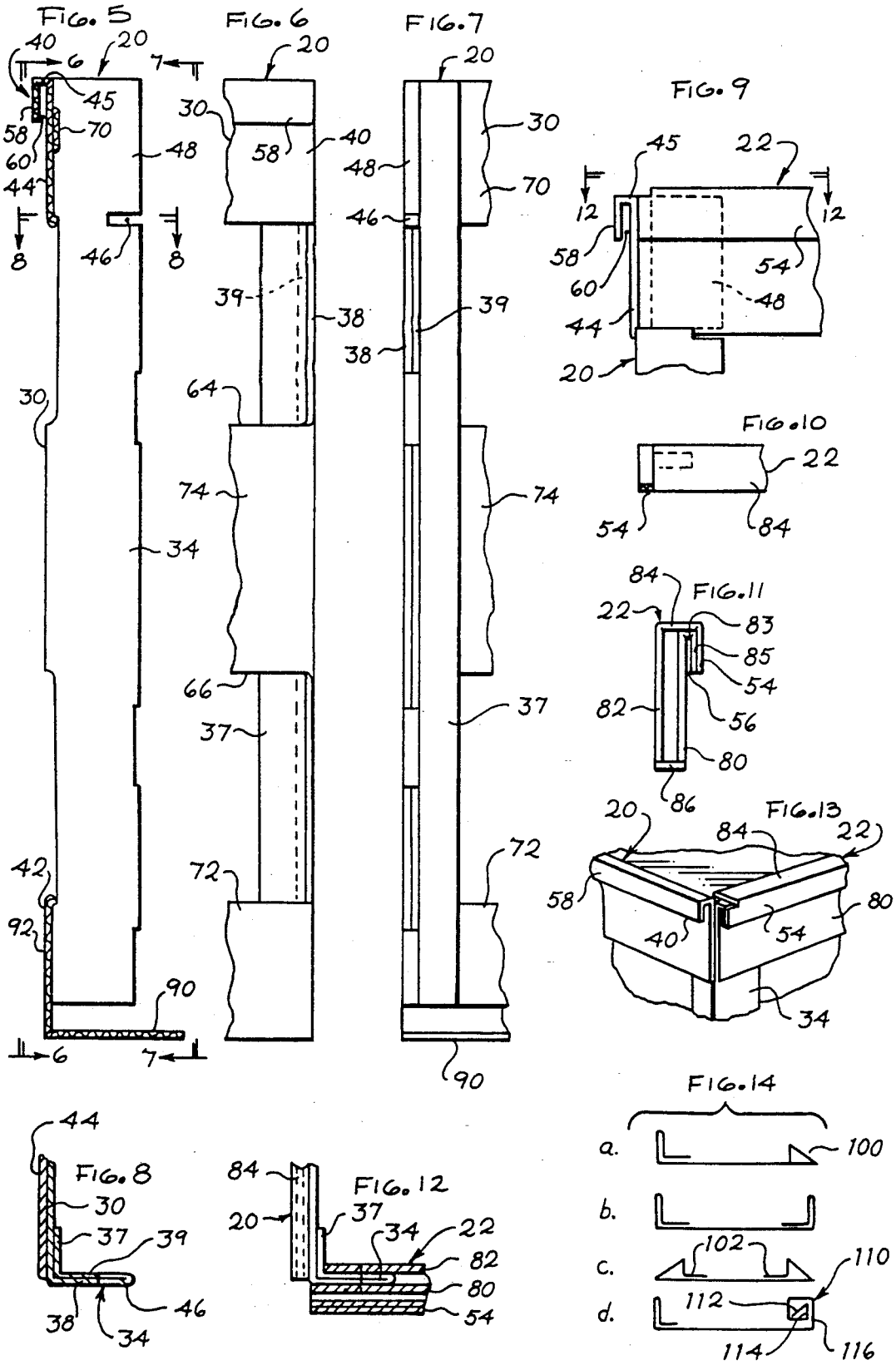
FIG. 5 is a front elevational view of the left-hand channel member illustrated in FIG. 1.
FIG. 6 is a rear elevational view thereof.
FIG. 7 is a front elevational view thereof, shown on an enlarged scale.
FIG. 8 is a fragmentary cross-sectional view taken along the line 8—8 of FIG. 5.
FIG. 9 is a fragmentary front elevational view of the upper left corner of the package assembly.
FIG. 10 is a fragmentary top plan view of the cross member.
FIG. 11 is a side elevational view of the cross member.
FIG. 12 is a fragmentary cross-sectional view taken along the line 12—12 of FIG. 9.
FIG. 13 is an enlarged view of the upper left corner of the package shown in FIG. 2.

Referring to FIG. 1, the channel members 20 include a middle portion 30 disposed between flanges 32, 34. The channel members 20 are preferably formed from a single integral blank, such as the blank 36 illustrated in FIG. 3. The flanges 32, 34 preferably comprise folded portions extended from the middle portion 30, so as to form L-shaped corner posts of the type illustrated in FIGS. 8 and 12. As can be seen in FIG. 8, the flange 34 includes overlying layers 38, 39 and an end portion 37, folded to-overlie middle portion 30. The layer 39 and end portion 37 comprise legs of an L-shaped crosssection. The channel members include flanges at their upper and lower ends, with a lifting flange 40 at the upper end, and a bottom flange 42 at the lower end. The upper, lifting flange 40 includes a joining part 44 and a top connecting portion 45 joining part 44 to the end portion 58. The bottom flange 42 includes a joining part 92 overlying wall 72, joining end portion 90 to the channel member.

Figure 4:
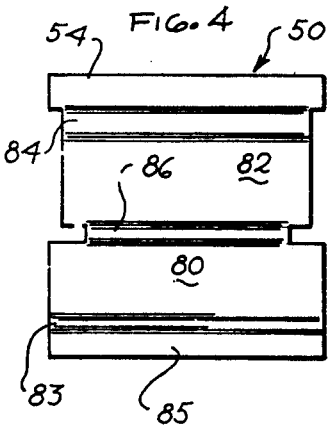
FIG. 4 is a top plan view of a blank from which the cross member of the carton assembly is made.

As can be seen in FIG. 1, the upper ends of the channel flanges 32, 34 are notched at 46 to form plug members 48 which extend toward one another, in generally horizontal directions. The cross member 22 is preferably formed from an integral paperboard blank, such as the blank 50 of FIG. 4, and is folded and assembled so as to have a hollow tubular body with notched or recessed end portions comprising socket members for receiving the plugs 48 of channel members 20. In the preferred embodiment, the cross member 22 is hollow throughout its longitudinal dimension, as can be seen in FIG. 11. The container assembly is assembled by inserting the plug members 48 into the open ends of cross member 22 for interlocking engagement therewith. If desired, the plug and socket members could be reversed, with the channel members folded to form socket portions at their upper ends, to receive end portions of cross member 22.

According to one aspect of the present invention, the cross member 22 and channel members 20 have lifting flanges incorporated therein for material handling of the packaging assembly using blade lift mechanisms. Referring to FIG. 11, for example, cross member 22 has a lifting flange 54 defining a blade-receiving recess 56. As can be seen in FIGS. 5, 9 and 13, for example, channel members 20 include lifting flanges 58 which define recesses 60 for receiving the lifting blade. According to one aspect of the present invention, as can be seen in FIGS. 2 and 13, the lifting flanges of the cross member and channel members meet at outside corners of the packaging assembly, and, thus, a lifting flange generally L-shaped in crosssection may be employed to lift a corner of the packaging assembly.

Referring additionally to FIGS. 5–7, the middle portions 30 of channel members 20 have upper and lower windows 64, 66 formed therein by striking out parts of the middle portion which are folded to form the upper and lower flanges 40, 42. Material from the upper window 64, for example, is folded to form the upper lifting flange 40 of the channel member. Before forming the window 64, 66, the middle portions 30 are preferably of generally planar construction and thus, when material is struck out from the windows 64, 66, a series of walls is formed in the middle portions 30. With reference to FIG. 6, for example, wall portions 70 and 72 are formed at the upper and lower ends of middle portion 30, one on each side of window openings 64, 66. An intermediate wall 74 is formed between window openings 64, 66 and as with the walls 70, 72, spans the distance between flanges 32, 34. Referring to FIG. 8, the flanges have free ends which are folded over, to form a double thickness cushioning layer at the corner where the flanges meet middle portion 30.

Referring now to FIGS. 1 and 9–12, cross member 22 includes front and rear walls 80, 82 and top and bottom walls 84, 86 forming a generally tubular hollow channel as can be seen in FIG. 11, for example. Flange 54 is comprised of a double wall thickness and is spaced from front wall 80 by recess 56. As can be seen in FIG. 10, the ends of cross member 22 have a stepped configuration with a notched or recessed bottom wall 86 so as to receive portion 86 of flanges 32, 34 extending between notches 46 and the exposed side of middle portion 30, overlaid by the upper lifting flange 40. The cross member 22 has a hollow tubular construction which is elongated in crosssection. The open ends of the cross member receive the plugs 48 of channel members 20, which are also elongated. These preferred configurations help prevent a twisting of cross member 22 about its central axis during a lifting operation, when a blade device lifts the package assembly by the lifting flange of the cross member. To further aid in preventing twisting, the lifting flange 54 extends beyond the tubular body portions of the cross member, so as to engage a greater surface area of the channel member.

According to one aspect of the present invention, material for the upper and lower lifting flanges is taken from the middle portion of channel members 20. Referring to FIG. 5, the upper lifting flange 40 is folded back upon wall 70 and has an upper free end formed with a reverse bend described above, forming downwardly opening recess 60. In a similar manner, the bottom flange 42 is folded along the outside surface of wall 72. Bottom flange 42 has a free end portion 90 bent at an angle to middle portion 30, so as to underlie a product contained within the packaging assembly.

Panel portions 83, 85 extend from the front wall 80, with the panel portion 85 in overlapping relationship with the exterior flange panel 54. It will therefore be seen that the lifting flange, which captivates the lifting blade, is formed by doublethickness wall portions, including wall portions 54, 85 at the front of the packaging assembly and wall portions 83, 84 at the top of the packaging assembly.

Turning now to FIG. 14, alternative embodiments of the channel members are shown in schematic form. FIG. **14*b* corresponds to the channel member illustrated in the preceding figures, having overlapping double thickness flanges. The channel members of FIGS. 14*a*, 14*d* have the same flange construction at their left hand ends. FIG. 14*a* has a right hand end 100 of generally triangular crosssection. The triangular crosssection is also found in the channel member of FIG. 14*c*, except that free end portions 102 are provided which overlap the middle portion of the channel member. The channel member of FIG. 14*d* has a flange 110 at its right hand side which is formed of multiple folds, having a crosssection which is generally square, and within which a V-shaped fold has been added, so as to provide a diagonal member 112 and a double thickness outside wall, formed by layers 114, 116. The channel members preferably have the same flange configurations at each guide, as in FIGS. 14*b*, 14*c*, but could also have flanges of different constructions, as in FIGS. 14*a*, 14*d***.

Figure 15:
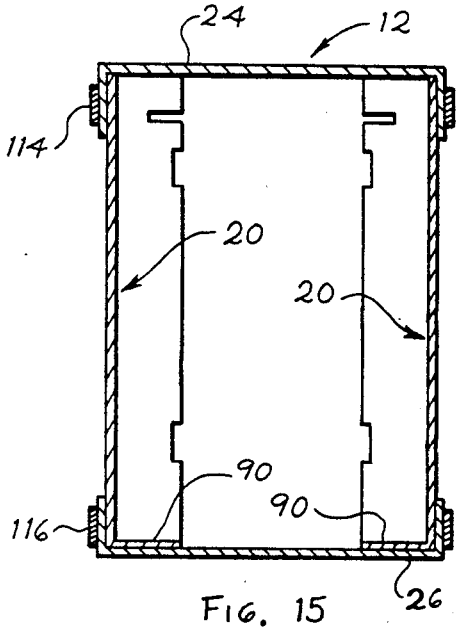
FIG. 15 is a schematic cross-sectional view of the package assembly.

Turning now to FIG. 15, the paperboard container 12 is illustrated in schematic form, as a cross-sectional view taken along a vertical plane passing through container 12. Channel members 20 are placed on either side of a product to be packaged, and if used, top and bottom closures 24, 26 are applied over the ends of the assembly in telescoping fashion.

Figure 17:
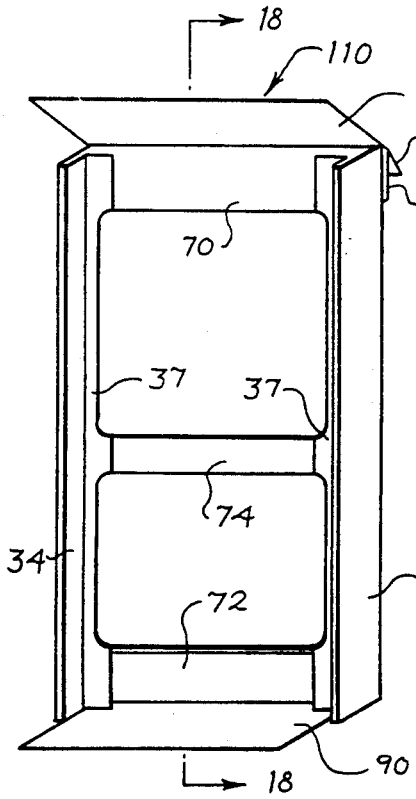
FIG. 17 is a perspective view of an alternative embodiment of a channel member according to principles of the present invention.

Turning now to FIG. 17, an alternative embodiment of a channel member is generally indicated at 110 and is substantially identical to the channel member 20, except for a cover flap 112 extending from the upper free edge of wall 70. The cover flap 112 of each channel member of a container is dimensioned so as to completely overlie the product being packaged, eliminating the need for top cap 24. As can be seen at the lower end of FIG. 17, and the cross-sectional view of FIG. 18, the bottom flap 90 is folded so as to contact the bottom edges of flanges 32, 34.

Figure 16:
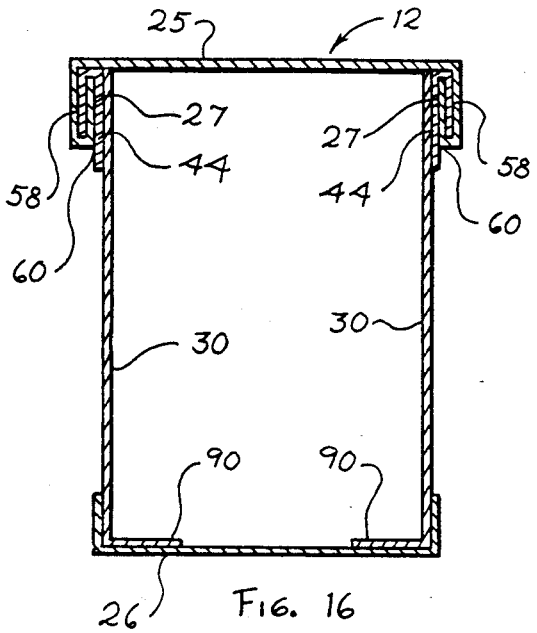
FIG. 16 is a schematic cross-sectional view of an alternative embodiment having an optional top cap construction.

FIG. 16 shows an alternative arrangement wherein a top cap 25 has a depending flange with a reversely bent lip portion 27 entering the recess 60, formed between flange 58 and the middle portion 30 of the channel members 20. In the preferred embodiment, the plastic film 14 is wrapped about the container, but not the lifting flange portions. Rather, the plastic film has an upper edge which overlays the body portion 44 which joins the lifting flange to the middle portion 30.

FIG. 15 further shows banding 114, 116 applied to the upper and lower ends of the container 12 to apply a compressive hoop stress thereto. The banding is preferably applied after the plastic film is applied to protect the product. In FIG. 15 the preferred arrangement is shown, with plastic film wrapped about both the carton and product disposed within. As mentioned, the plastic film preferably enters the recess at the upper end of the container between the lifting flange and the middle portion of the channel member. The plastic film is preferably wrapped underneath the free ends 90 of the bottom flange, before the lower cap 26 is installed. After fitting of lower cap 26 in the manner shown in FIG. 15, banding 116 is applied to hold the cap in position. After the optional but preferred cap 24 is in place, in the manner illustrated in FIG. 15, banding 114 is applied to hold cap 24 in position. The banding 114 is preferably tightened so as to compress the lifting flange, decreasing the width or gap size of recess 60.

Figure 18:
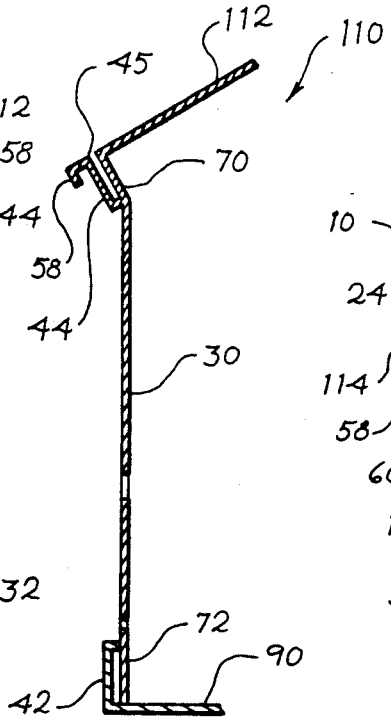
FIG. 18 is a cross-sectional view taken along the line 18—18 of FIG. 17.

In FIGS. 17, 18, the lifting flange 58 is shown extending from connecting portion 44 at an acute angle, and such is the visual impression on some commercial embodiments of packaging assembly, according to principles of the present invention. In fact, the connecting portion 45 of the preferred embodiment, as illustrated in FIG. 5, becomes rounded when compressed by banding wrapped about the outer surface of the lifting flange.

Figure 19:
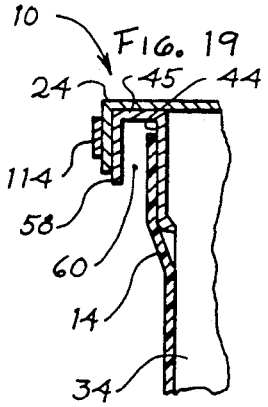
FIG. 19 is a fragmentary cross-sectional view of the packaging assembly, shown in a fully assembled condition.

Referring now to FIG. 19, final assembly of the packaging assembly will be described. The side channels 20 have been applied to the product to be packaged, and cross member 22 is interlocked with the channel members. A second cross member 22 can be employed, if desired, the rear side of the channel members. Plastic film 14 is overwrapped about the paperboard container in the manner illustrated in FIG. 19, with an upper edge entering the recess or pocket portion 60 formed between the lifting flange 58 and the connecting portion 44, folded against wall 70 of the channel middle portion. An optional cap member 24 is applied, with a depending flange overlying the lifting flange 58.

A banding member 114 of suitable, flexible material, either a plastic, plastic composite or metal, is wrapped about the upper perimeter of the packaging and is tightened, with the gap size of the pocket 60 being reduced. If cap 24 is omitted, the banding 114 directly contacts the lifting flange 58. Even if the pocket 60 is compressed to a negligible dimension, the lifting blade can reopen the gap without difficulty during a lifting operation. If desired, the bottom free end of lifting flange 58 can be reverse-folded in an upward direction toward connecting portion 44, so as to provide a smooth, rounded)reinforced edge to accommodate entry of the lifting blade into the collapsed gap 60. Further, if desired, the depending flange of cap 24 can also wrap around the bottom end of lifting flange 58, entering gap 60, and this feature can be provided whether or not lifting flange 58 is provided with a folded free end portion entering gap 60. In either event, the bottom edge of lifting flange 58 will be reinforced and a smooth camming surface will be provided for the lifting blade, enhancing the commercial utility of packaging assembly 10.

Figure 20:
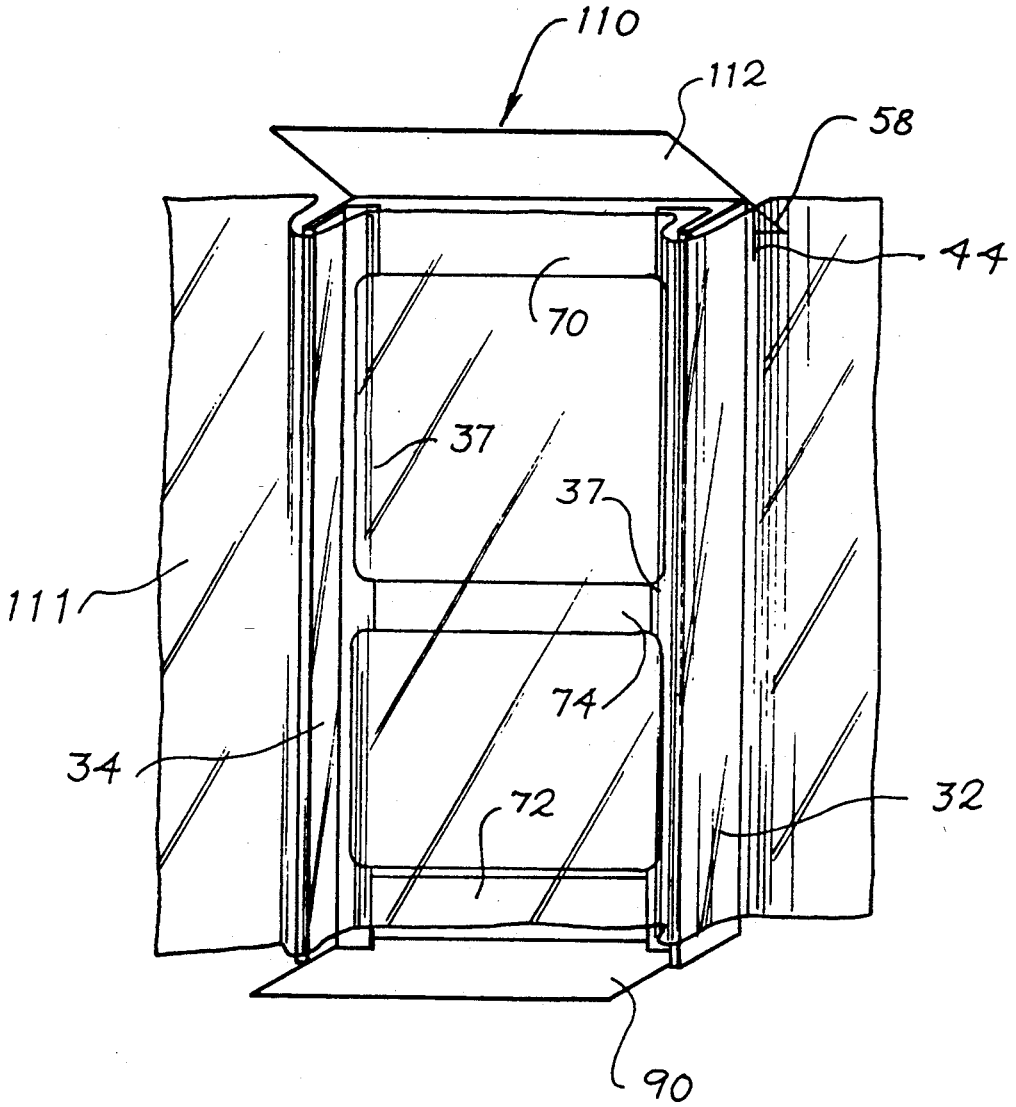
FIG. 20 is a perspective view of a further alternative embodiment of a channel member according to principles of the present invention.

If desired, the plastic wrap may be applied to the interior of the carton, as illustrated in FIG. 20 wherein a plastic liner 111 is disposed on the interior surfaces of channel member 110. The plastic liner may be secured to the carton members by a suitable adhesive, if desired, to aid in an automated or semi-automated assembly of the package. Further, the plastic liner may take the form of a tube or bag disposed about the article to be packaged, or may be shrink-wrapped about the article prior to placing the carton about the article. In these latter alternative embodiments, additional banding may be required to hold the carton in position. For example, additional banding may be employed at the lower end of the carton to hold the channel members together. One or more additional cross members preferably, but not necessarily, of the interlocking type, and/or cap members (such as the cap members 24, 26 mentioned above) may also be employed at the lower end of the carton assembly.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Container for holding an article having opposed sides, comprising:

a pair of channel members for engaging opposed sides of the article, each channel member formed from a single integral paperboard sheet and each having a middle body portion between a pair of channel sides extending from the middle body portion so as to form corner posts and an intermediate channel therewith for receiving the article;

at least one cross member extending between and engaging said channel members;

securement means for securing said channel members about the article;

said channel members including a lifting flange for lifting the container and article with a lifting blade; and at least one of said channel members and said cross member defining socket means for interlocking engagement with the other.

2. The container of claim 1 wherein said channel members further comprise a bottom flange, with the lifting flange and bottom flange struck out of said middle body portion so as to define at least one opening through which the article may be viewed.

3. The container of claim 2 wherein said lifting flange and said bottom flange are struck out of said middle body portion so as to define two spaced apart openings separated by a part of said middle body portion.

4. The container of claim 3 wherein said lifting flange and said bottom flange have respective joining parts foldably connected to and at least partly overlying said middle body portion.

5. The container of claim 4 wherein said middle body portion has an outside surface facing away from the article and said lifting flange and said bottom flange overlie said outside surface.

6. The container of claim 5 wherein said lifting flange has a flange portion folded away from the article in a downward direction so as to form a downwardly opening recess for receiving a lifting blade for lifting the container.

7. The container of claim 1 wherein said cross member has a double ended tubular body which is notched at the ends to receive portions of said corner posts.

8. The container of claim 7 wherein said channel sides of respective channel members extend toward the other channel member, and define notches for receiving the notched ends of said cross member for interlocking engagement therewith.

9. The container of claim 7 wherein said corner posts have generally L-shaped cross-section, with one leg of the L overlying said middle body portion and the other leg of the L, formed by said channel sides, defining said notches.

10. The container of claim 7 wherein said cross member is formed from a single integral paperboard sheet and includes a lifting flange for lifting the container with a lifting blade.

11. Container for holding an article having opposed sides, comprising:

a pair of channel members for engaging opposed sides of the article, each channel member formed from a single integral paperboard sheet and each having a middle body portion between a pair of flanges extending from the middle body portion so as to form corner posts and an intermediate channel therewith for receiving the article;

at least one cross member extending between and engaging said channel members;

securement means for securing said channel members about the article;

said channel members including a bottom flange and a lifting flange for lifting the container and article with a lifting blade, said bottom flange and said lifting flange struck out of said middle body portion so as to define two spaced apart openings; and said lifting flange and said bottom flange have respective joining parts foldably connected to and at least partly overlying said middle body portion.

12. The container of claim 11 wherein said middle body portion has an outside surface facing away from the article and said lifting flange and said bottom flange overlie said outside surface.

13. The container of claim 12 wherein said lifting flange has a flange portion folded away from the article in a downward direction so as to form a downwardly opening recess for receiving a lifting blade for lifting the container.

14. The container of claim 11 wherein at least one of said channel members and said cross member define socket means for interlocking engagement with the other.

15. The container of claim 14 wherein said cross member is formed from a single integral paperboard sheet and includes a lifting flange for lifting the container with a lifting blade.

16. The container of claim 15 wherein said cross member has a double ended tubular body which is notched at the ends to receive portions of said corner posts.

17. The container of claim 16 wherein said corner posts of respective channel members extend toward the other channel member, and define notches for receiving the notched ends of said cross member for interlocking engagement therewith.

18. The container of claim 17 wherein said corner posts have generally L-shaped cross-section, with one leg of the L overlying said middle body portion and the other leg of the L defining said notches.

19. The container of claim 17 wherein said securement means for securing said channel members about the article comprises banding means for surrounding an end of the container so as to apply a compressive hoop stress thereto.

20. A container member formed from a single integral sheet of paper material so as to be foldable to form a channel member having a middle body portion between a pair of channel sides which extend from the middle body portion so as to form corner posts and a channel therewith for receiving an article, the container member comprising:

a serial succession of first, second and third sapced apart walls, with the second wall between the first and third walls;

a lifting flange for lifting the channel member and article with a lifting blade, stuck from the sheet between the first and second walls so as to define a first opening through which the article may be viewed;

a bottom flange stuck from the sheet between the second and third walls so as to define a second opening through which the article may be viewed;

a pair of channel sides; and the first, second and third walls located between said channel sides and having opposed ends foldably connected to respective channel sides.

21. The container member of claim 20 wherein each channel side comprises two generally coextensive foldably connected wall panels.

22. Package assembly for holding an article having opposed sides, comprising:

a pair of channel members for engaging opposed sides of the article, each channel member formed from a single integral paperboard sheet and each having a middle body portion between a pair of flanges extending from the middle body portion so as to form corner posts and an intermediate channel therewith for receiving the article;

at least one cross member extending between said channel members;

securement means for securing said channel members about the article;

said channel members including a bottom flange and lifting flange for lifting the container and article with a lifting blade, said bottom flange and said lifting flange struck out of said middle body portion so as to define two spaced apart openings;

said lifting flange and said bottom flange have respective joining parts foldably connected to and at least partly overlying said middle body portion; and at least one sheet of flexible material extending at least partly across said spaced apart openings and engaging said channel members so as to protect an article disposed between said channel members.

23. The container of claim 22 wherein the flexible material at least partly surrounds the channel members.

24. The container of claim 22 wherein the flexible material is disposed between the channel members.

* * * * *

UNITED STATES PATENT AND TRADEMARK OFFICE

CERTIFICATE OF CORRECTION

PATENT NO. : 5,289,969

DATED : March 1, 1994

INVENTOR(S) : Schwaner

It is certified that error appears in the above-indentified patent and that said Letters Patent is hereby corrected as shown below:

IN THE CLAIMS:

Claim 20, Column 9, line 25, change "sapced" to --spaced--.

Column 9, claim 20, line 29, change "stuck" to --struck--.

Claim 20, Column 9, line 33, change "stuck" to --struck--.

Signed and Sealed this

Fifth Day of July, 1994

*Attest:*

*Attesting Officer*

BRUCE LEHMAN

*Commissioner of Patents and Trademarks*